US012343614B2

(12) United States Patent
Kustin

(10) Patent No.: US 12,343,614 B2
(45) Date of Patent: Jul. 1, 2025

(54) SEWABLE DOWEL FOR USE IN GYMNASTICS GRIPS

(71) Applicant: Misha Kustin, Bloomfield, NJ (US)

(72) Inventor: Misha Kustin, Bloomfield, NJ (US)

( * ) Notice: Subject to any disclaimer, the term of this patent is extended or adjusted under 35 U.S.C. 154(b) by 209 days.

(21) Appl. No.: 18/058,870

(22) Filed: Nov. 27, 2022

(65) Prior Publication Data

US 2024/0173611 A1 May 30, 2024

(51) Int. Cl.
*A63B 71/14* (2006.01)
*A63B 21/00* (2006.01)

(52) U.S. Cl.
CPC ..... *A63B 71/14* (2013.01); *A63B 21/4021* (2015.10)

(58) Field of Classification Search
CPC ..... A63B 71/14; A63B 21/4021; A63B 26/00; A41D 20/00; A41D 19/00; A41D 19/0024; A41D 19/0037; A41D 19/0034; A41D 19/01594
See application file for complete search history.

(56) References Cited

U.S. PATENT DOCUMENTS 676,650 A * 6/1901 Mendels ..... A41D 27/22 2/271
5,298,001 A 3/1994 Goodson
2005/0081273 A1* 4/2005 Ota ..... A63B 71/14 2/17
2022/0235605 A1* 7/2022 Teuscher ..... E06B 9/368

FOREIGN PATENT DOCUMENTS

CA 2423409 12/2006

OTHER PUBLICATIONS

Saltys Pirate Den, 10 Large Wood Toggle Button, Mar. 19, 2022, Etsy, Craft Supplies & Tools, pp. 1-4 (Year: 2022).*
Oliver_2099, Stainless Steel Dowel Pin with Two Holes, 2024, Ebay, Dowel Pins, pp. 1-2 (Year: 2024).*
https://reisport.com/collections/women-s-gymnastics-grips/products/gr-3510a [retrieved on Nov. 16, 2022].
https://reisport.com/collections/men-s-gymnastics-grips/products/gr-3507a [retrieved on Nov. 16, 2022].
https://reisport.com/collections/ring-grips/products/gr-3506a [retrieved on Nov. 16, 2022].
https://www.usglove.com/collections/ladies-grips/products/ladies-regular-uneven-bar-buckle-grips [retrieved on Nov. 16, 2022].

* cited by examiner

*Primary Examiner* — Sundhara M Ganesan
*Assistant Examiner* — Jacqueline N L Loberiza

(57) ABSTRACT

An improved dowel for use in uneven bar, horizontal bar, and still ring gymnastics grips. Said dowel comprises a cylindrical rod of predetermined diameter, length, and rigidness which has a plurality of holes that are perpendicular to the length of the dowel and parallel to each other with respect to their center line. Said holes are spaced to be sewn either by a sewing machine or by hand, whereby said dowel provides a means for being sewn directly into the gymnastics grip.

4 Claims, 5 Drawing Sheets

SEWABLE DOWEL FOR USE IN GYMNASTICS GRIPS

FIELD OF THE INVENTION

The present invention relates to apparatus for use in the sport of gymnastics, and more specifically, the dowel of a gymnastics grip intended to be used on the uneven bars, the horizontal bar, and the still rings.

BACKGROUND OF THE INVENTION

On the uneven bars, the horizontal bar, and the still rings a gymnastics grip is often used to assist the gymnast in holding on to the event. Grips are made of a soft, pliable, and durable material with a cuff piece and a palm piece. The cuff piece wraps around the wrist of the gymnast. The palm piece extends crossways from the cuff piece, laying in the gymnast's hand. At the end of said palm piece, opposite the cuff, a plurality of holes exist for the gymnast's fingers. Near the finger end of the grip, a dowel approximately the width of the palm piece, is attached roughly or exactly perpendicular to the length of the palm piece. This dowel serves to assist in the mechanical advantage the grip provides to the gymnast.

Manufacturers of gymnastics grips have predominantly used two methods to attach the dowel to the gymnastics grip. The first and most widely used method is to sew an additional piece of leather to the palm portion of the grip. Then, a rigid, or semi rigid dowel is rolled inside this additional piece of leather by means of an adhesive. The second method is to use a hollow cylinder and tie the dowel in place with a string or line. A third alternative, published in Canadian Patent 2,423,409 (Mah), describes a method to attach the dowel with a combination of stitch lines and rolling.

The first shortcomings of these designs is their strength in relation to keeping the dowel in place. A simple rolled dowel can, and is known to come undone occasionally. A string or line running through the grip has also been known to fail. Canadian Patent 2,423,409 (Mah) claims to overcome this hurdle however, with increased complexity of production.

The present invention provides manufacturers of gymnastics grips the possibility of sewing dowels directly into the gymnastics grip. This direct sewing simplifies fabrication, reducing material and production costs as compared to the prior art. Simultaneously, the dowel is more secure to the palm piece of the gymnastics grip, again as compared to the prior art.

In a preferred embodiment a cylindrical dowel body of predetermined diameter, length, and rigidness has a plurality of holes wherein each of the plurality of holes are positioned perpendicular with the length of the cylindrical dowel body and wherein each of the plurality of holes comprises a centerline and the centerlines of each of the plurality of holes are parallel to one another. The plurality of holes are spaced apart for the cylindrical dowel body to be sewn with the grips.

An additional, although optional feature of a preferred embodiment, is to include an open space or thread ditch, for the thread to sit inside the cylindrical dowel body.

DETAILED DESCRIPTION OF THE DRAWINGS

Figure 1:
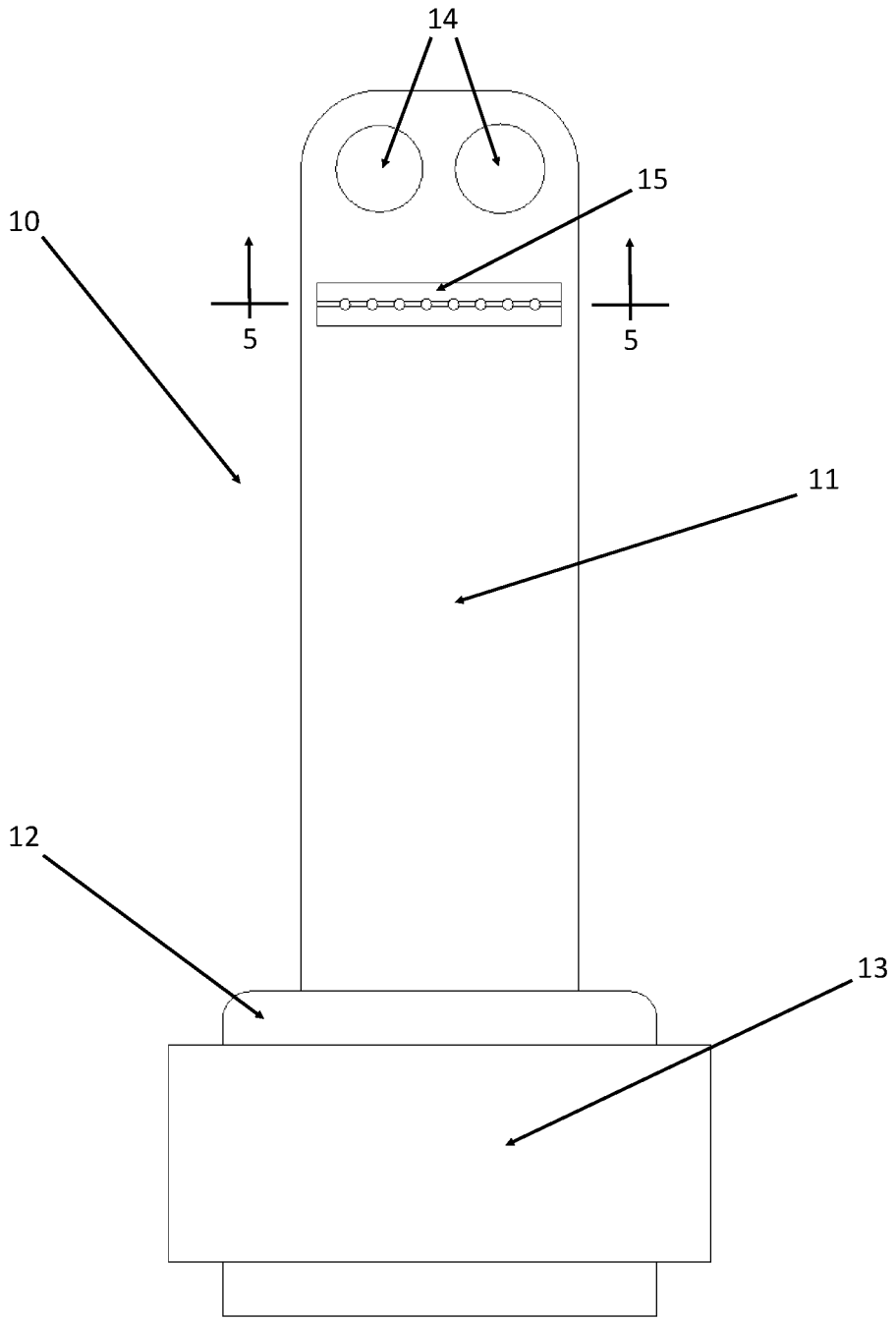
FIG. 1 is a view of the backside of a gymnastics grip apparatus with the preferred embodiment.
Figure 2:
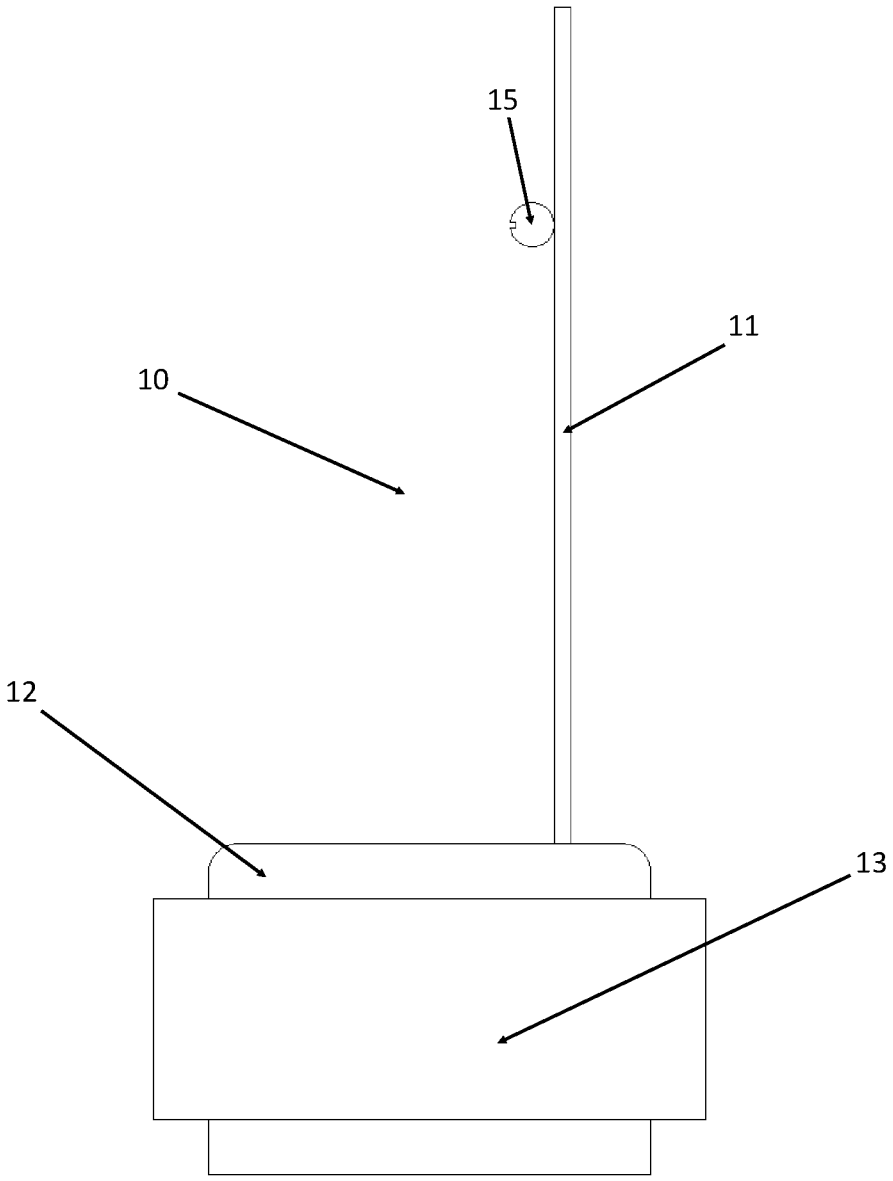
FIG. 2 is a side view of a gymnastics grip apparatus with the preferred embodiment.

Referring to FIGS. 1 and 2, a gymnastics grip 10, has a palm piece 11 and a cuff piece 12. The palm piece 11 and cuff piece 12 should be made of a soft, pliable, and durable material. Such material could be a high grade leather.

Referring to FIGS. 1 and 2, the cuff piece 12 is attached to the gymnast's wrist with attachment 13. Attachment 13 can be any closure method used to secure the cuff piece 12 to the gymnast's wrists. Examples of attachment 13 include, but are not limited to, a strap with hook and loop, a single buckle, a plurality of buckles, or a combination of closure methods.

Referring to FIGS. 1 and 2, the palm piece 11 is attached nearly, or exactly perpendicularly to the cuff piece 12. The palm piece 11 lays on the palm side of the gymnast's hand with a plurality of finger holes 14 near the end of the palm piece 11, opposite the cuff piece 12.

Dowel 15 should be of a material that is rigid or semi rigid. A material that is too soft will negate the mechanical advantage afforded to the gymnast. Examples of appropriate materials are, but not limited to, plastic, wood, or rubber.

Referring to FIGS. 1 and 2, the dowel 15 should be of a predetermined size. The diameter of dowel 15 should be appropriate and unique to the apparatus, although other factors could be considered. An embodiment of dowel 15, designed for uneven bars and the horizontal bar, could have a diameter of 8 mm. However, other sizes could be adequate. On the still rings, a possible embodiment could have a diameter of 16 mm, with other sizes also being functional. The length of dowel 15 should be congruent with palm piece 11 as to provide proper mechanical advantage to the athlete. An example embodiment, could have the width of palm piece 11 and the length of dowel 15, 50 mm and 40 mm respectively.

Referring to FIGS. 1 and 2, the dowel 15 should be placed in a predetermined position. Appropriate distances for dowel 15 away from finger holes 14 has multiple considerations, including but not limited to, the diameter of the dowel 15, the intended apparatus use, and the athlete. The dowel should however be placed significantly closer to finger holes 14, than to cuff 12. Embodiments of dowel 15, with reference to the distance away from finger holes 14, could range from 15 mm to 35 mm. However, other configurations might be considered.

Figure 3:
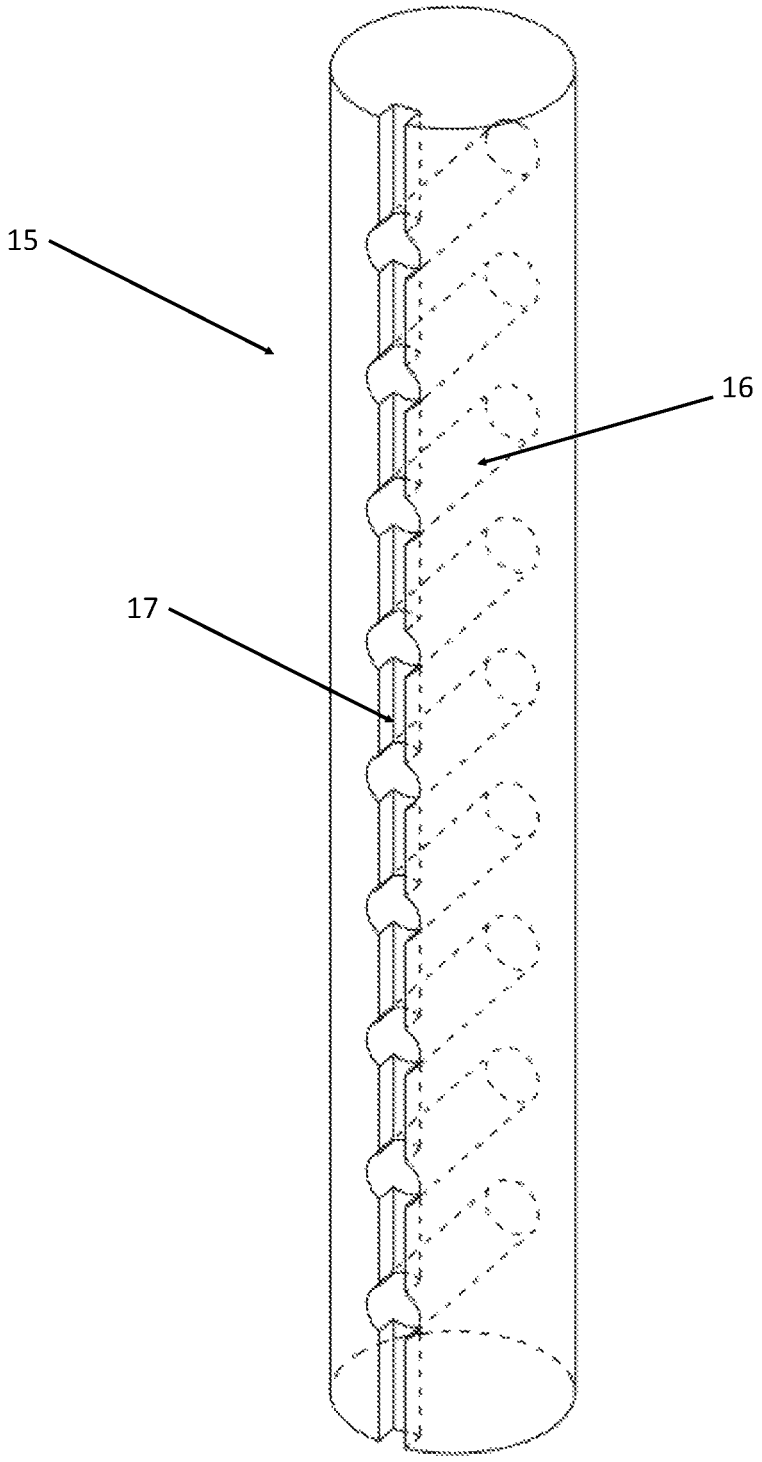
FIG. 3 is an isometric wireframe view of the preferred embodiment.
Figure 4:
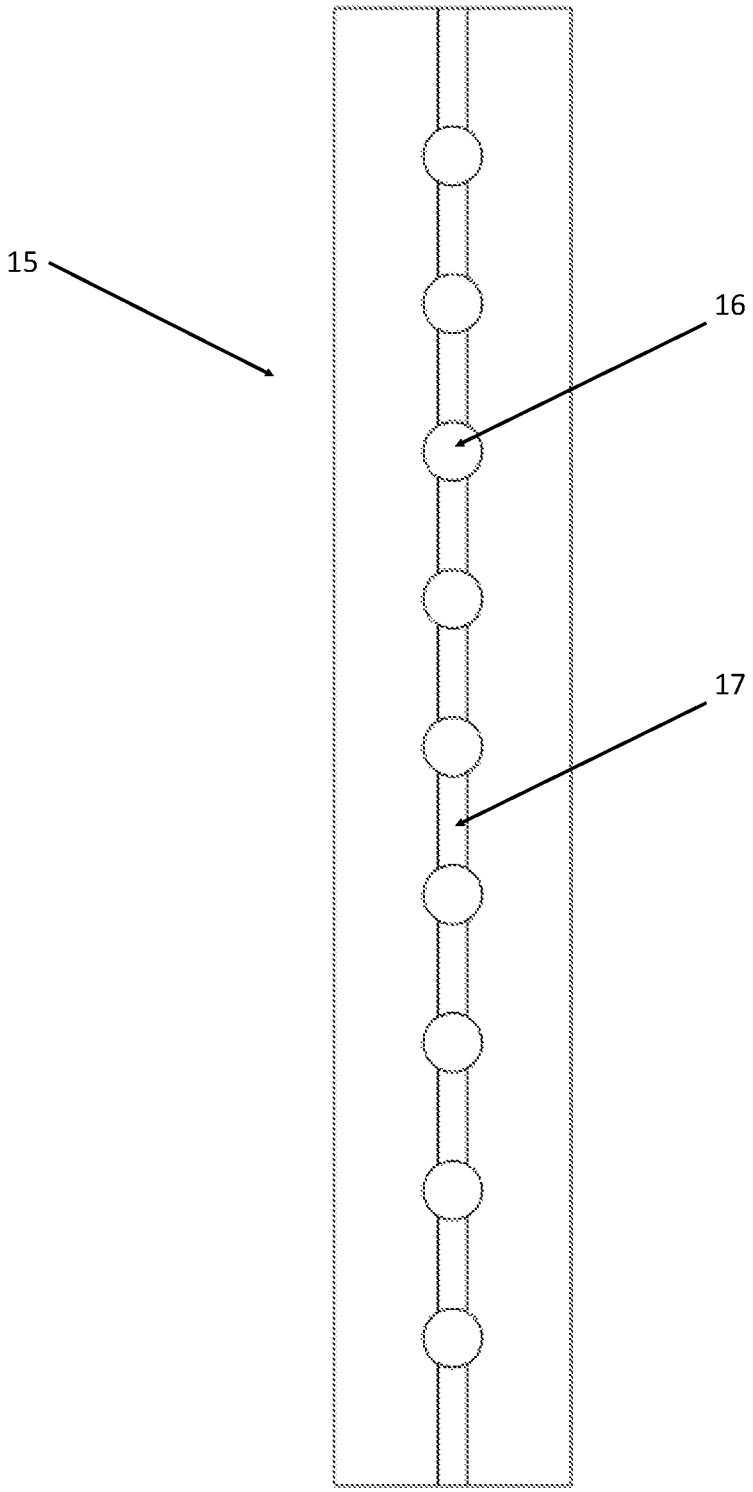
FIG. 4 is a front wireframe view of the preferred embodiment.
Figure 5:
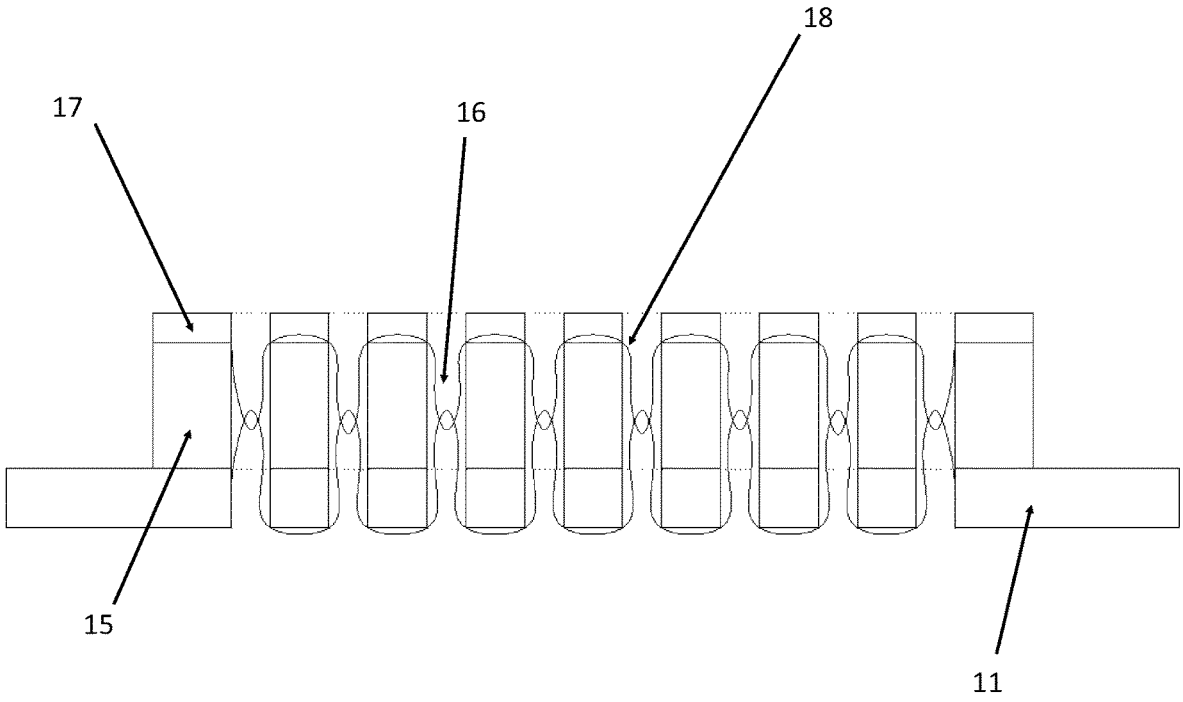
FIG. 5 is a cross-sectional view of the preferred embodiment taken along 5-5.

FIGS. 3, 4 and 5 illustrate the details of dowel 15. A plurality of holes 16, extend through the diameter of dowel 15 wherein each of the plurality of holes 16 are positioned perpendicular with the length of dowel 15 and wherein each of the plurality of holes 16 comprises a centerline and the centerlines of each of the plurality of holes are parallel to one another. The holes 16 should be of a diameter to allow a threaded needle to pass, but not too wide as to introduce potential structural weakness. A possible, but not limiting, embodiment for holes 16 could have a diameter of 2 mm. Said holes should be spaced to allow for an adequate number of stitches and consequential seam strength with thread 18. Too many holes however could introduce structural weakness. Considerations for patterns could include the overall length of dowel 15, the diameter of dowel 15, the intended apparatus, and the athlete.

FIGS. 3, 4, and 5 illustrate an additional and optional feature of dowel 15, a thread ditch 17. Thread ditch 17 allows the thread to lay inside the dowel. One purpose of thread ditch 17 is to protect thread 18 from potential abrasion forces during use. Thread ditch 17 should be deep and wide enough to keep thread 18 from being outside dowel 15's diameter. If thread ditch 17 is too wide the circular nature of the dowel will be compromised. If thread ditch 17 is too deep, dowel 15's structural integrity could be compromised. As such, thread ditch 17 should be appropriately sized with the size of thread 18. One possible embodiment could have a width and depth of 1 mm.

FIG. 5, a cross-section view of 5-5, illustrates how one could sew the dowel 15 directly to palm piece 11 with thread 18. A plurality of sewing methods could be used to achieve this end, including hand sewing and machine sewing.

The invention claimed is:

1. A dowel for use in grips for at least one of an uneven bar, a horizontal bar, or still rings for gymnastics, comprises a cylindrical dowel body of predetermined diameter, length, and rigidness which has a plurality of holes wherein each of the plurality of holes are positioned perpendicular with the length of the cylindrical dowel body and wherein each of the plurality of holes comprises a centerline and the centerlines of each of the plurality of holes are parallel to one another, and said plurality of holes are spaced apart for the cylindrical dowel body to be sewn with the grips, whereby a means for being sewn directly into said grips comprises a plurality of holes.

2. The said cylindrical dowel body of claim 1, further including a thread ditch to said cylindrical dowel body as a means to have said sewing thread sit inside said cylindrical dowel body.

3. A method of attaching the dowel to an uneven bar gymnastics grip, a horizontal bar gymnastics grip, or a still ring gymnastics grip:

a. using the dowel of predetermined diameter, length, and rigidness which has a plurality of holes wherein each of the plurality of holes are positioned perpendicular with the length of the dowel and wherein each of the plurality of holes comprises a centerline and the centerlines of each of the plurality of holes are parallel to one another;

b. aligning said dowel to a predetermined location on a palm piece of said gymnastics grip;

c. sewing said dowel to said gymnastics grip.

4. The dowel of claim 3, further including a thread ditch to said dowel as a means to have said sewing thread sit inside said dowel.

* * * * *